US005727403A

United States Patent [19]

Na

[11] Patent Number: 5,727,403

[45] Date of Patent: Mar. 17, 1998

[54] WASHING MACHINE WITH A VARIABLE PULSATOR

[75] Inventor: Jae-Hyun Na, Kwang-Ju, Rep. of Korea

[73] Assignee: Daewoo Electronics Co., Ltd., Seoul, Rep. of Korea

[21] Appl. No.: 596,444

[22] Filed: Feb. 2, 1996

[30] Foreign Application Priority Data

Jul. 21, 1995 [KR] Rep. of Korea ..... 94-21599

[51] Int. Cl.[6] ..... D06F 17/08; D06F 17/10

[52] U.S. Cl. ..... 68/133; 68/134

[58] Field of Search ..... 68/131, 133, 134, 68/53

[56] References Cited

U.S. PATENT DOCUMENTS 3,245,235 4/1966 Long ..... 68/131 X

*Primary Examiner*—Philip R. Coe

*Attorney, Agent, or Firm*—Beveridge, DeGrandi, Weilacher & Young LLP

[57] ABSTRACT

A revolving shaft disposed at a bottom of a stationary tub has first axial grooves. A washing tub revolvable on the revolving shaft has a spiral guide groove formed at its lower inner surface. A pulsator is rotatably mounted on a bottom in the washing tub. The pulsator has guide projections which are formed on its outer side of the pulsator and guided along the guide groove of the washing tub, and has second axial grooves which are spline-engaged with the first axial grooves of the revolving shaft. A variable pulsator is disposed on the pulsator of the revolving shaft, and has third axial grooves spline-engaged with the first axial grooves and a compressed spring therein so that the bottom of the variable pulsator is tightly contacted with a top of the pulsator by its elasticity. When the revolving shaft is revolved, the bottom of the variable pulsator is moved up and down depending on the upward and downward movement of the pulsator, so that the variable pulsator is expanded and shrunk in width.

8 Claims, 3 Drawing Sheets

WASHING MACHINE WITH A VARIABLE PULSATOR

BACKGROUND OF THE INVENTION

1. Field of the Invention

The present invention relates to a washing machine, and more particularly to a washing machine with a variable pulsator for preventing tangles and twists of laundry articles.

2. Prior Art

Generally, washing machines are classified into a vortex-type washing machine, a stirrer-type washing machine, and a drum-type washing machine according to the washing manner.

Among those washing machines, the vortex-type washing machine is provided with a pulsator rotatably mounted on the bottom of its washing tub. The pulsator is rotated by driving the motor. The rotation of the pulsator generates the vortex current of the washing water in the washing tub. The vortex current strikes the laundry articles, whereby they are rotated to be washed. The vortex-type washing machines are divided into one-tub-type washing machines and two-tub-type washing machines.

The stirrer-type washing machine is provided with a washing rod called an agitator which is disposed at the center of the washing tub. When the washing rod is regularly rotated, the water current is generated by the bladed washing rod, and the laundry articles are rubbed with the washing rod and the wall of the washing tub, thereby being washed.

Compared with the vortex-type washing machine, the stirrer-type washing machine is better in cleaning efficiency, makes the laundry articles less tangled, and allows larger volume of laundry by the bladed washing rod rotated at its center, whereas in the vortex-type washing machine, the rubbed area between the laundry and the washing tub is increased and cloths of the laundry can be injured, and it is improper to wash a massive laundry article by the washing rod.

The drum-type washing machine is provided with a cylindrical drum having a plurality of washing water communication holes inside the stationary tub. The cylindrical drum is so disposed that its revolving shaft of longitudinal direction is parallel to the surface of the washing water in the stationary tub. When washing, this drum revolves on the revolving shaft of longitudinal direction, and the laundry articles revolve about the revolving shaft hanging on projections formed on the inner surface of the cylindrical drum, thereby they become washed. The drum-type washer is the proper one for washing a large volume of laundry articles.

Among the above-mentioned washing machines, the vortex-type washer is generally used for domestic use, and recently, an automatic washer, one-tub-type washer in which washing and dehydration are carried out in the same tub, has been commonly used.

Hereinafter, the conventional one-tub-type washer of the vortex-type washing machines will be described in detail with reference to FIG. 1.

FIG. 1 is a schematic cross-sectional view of a one-tub type washing machine having a pulsator according to the prior art.

As shown in FIG. 1, reference numeral 10 denotes a stationary washer tub, in which a rotating shaft 60 is upwardly installed at the center of the bottom thereof, and a washing tub 20 is connected with rotating shaft 60. Washing tub 20 has a plurality of washing water communication holes. A pulsator 30 is rotatably placed on the bottom of the washing tub 20 for generating a vortex current. A driving part 40 having a motor 41 and clutch assembly 43 is installed at the predetermined position of the lower part of the outside of stationary tub 10 in order to drive washing tub 20 and pulsator 30.

The washing water received in stationary tub 10 is rotated by rotation of pulsator 30, thereby the laundry articles become washed.

The rotation of the above-mentioned conventional pulsator 30 generates a heart-shaped vortex current which rises along the wall of washing tub 20 and then falls toward the center of washing tub. Washing by the vortex current is good in cleaning efficiency. However, since the current forms a circle in the horizontal plane, the laundry articles become tangled and twisted with each other. Therefore, there is problem that their cloths are easily injured when washing thin and soft clothes.

SUMMARY OF THE INVENTION

The present invention has been made to overcome the above-described problems of the prior art, and accordingly it is an object of the present invention to provide a washing machine with a variable pulsator for preventing tangles and twists of laundry articles.

To achieve the above object, the present invention provides a washing machine with a variable pulsator comprising:

a stationary tub for receiving washing water during a washing operation;

a rotating shaft disposed on a bottom surface of the stationary tub the rotating shaft being a double shaft composed of a pulsator-rotating shaft and a washing tub-rotating shaft;

a washing tub installed in the stationary tub under a rotatable condition with the washing tub-rotating shaft, the washing tub having a plurality of washing water communication holes, and the washing tub having a spiral guide groove formed on its lower inner surface; and a pulsator installed at a lower part of the pulsator-rotating shaft in the washing tub under a rotatable condition with the pulsator rotating shaft, and a circular edge of the pulsator being guided along the spiral guide groove of the washing tub so that while the pulsator is rotated by the pulsator-rotating shaft, the pulsator is movable up or down along the pulsator-rotating shaft depending on the rotating direction; and a variable pulsator disposed at an upper part of the pulsator on the pulsator-rotating shaft under a rotatable condition with the pulsator-rotating shaft, a top of the variable pulsator being fixed on the pulsator-rotating shaft, and a bottom part of the variable pulsator being in contact with the pulsator, so that when the pulsator is moved upwardly, the bottom part of the variable pulsator contacted on the pulsator is moved upwardly and thereby a width of the variable pulsator becomes wider and when the pulsator is moved downwardly, the bottom part of the variable pulsator contacted on the pulsator is moved downwardly and thereby the width of the variable pulsator becomes narrower; and a driving part for rotating only the pulsator-rotating shaft or for rotating both the pulsator-rotating shaft and the washing tub-rotating shaft depending on a washing mode in order to operate the washing tub, the pulsator, and the variable pulsator.

In the washing machine with a variable pulsator, the pulsator has a main body of a round plate shape having an opening formed at its center and a plurality of communication holes through which washing fluid flows freely, and a plurality of ribs formed on an upper surface of the main body.

In the washing machine with a variable pulsator, the washing tub has a spiral guide groove formed at its lower inner surface and the pulsator has guide projections formed at corresponding positions on the outer side of the main body of round plate shape.

In the washing machine with a variable pulsator, the rotating shaft has first axial grooves; the pulsator has second axial grooves which are spline-engaged with the first axial grooves and formed on the inner side of its main body, so that, in the rotation of the rotating shaft, the pulsator is movable upward and downward simultaneously with rotation of the pulsator.

In the washing machine with a variable pulsator, the variable pulsator is a hollow body of which plane cross section has a star shape, the variable pulsator having a bottom with an opening formed at its center, inner side of which is provided with third axial grooves spline-engaged with the first axial grooves, whereby, in the rotation of the rotating shaft, the bottom of the variable pulsator is moved up and down depending on the upward and downward movement of the pulsator, so that a width of the variable pulsator becomes wider or narrower.

In the washing machine with a variable pulsator, the variable pulsator has a spring therein through which the rotating shaft is inserted, whereby the bottom of the variable pulsator is tightly contacted with a top of the pulsator by its elasticity.

According to the washing machine of the present invention constructed as described above, in a washing operation, the circular water current in the horizontal plane generated by the rotation of the pulsator can be broken by the water current generated by expansion and shrinkage of the variable pulsator in width. Therefore, it can be prevented that the laundry articles are tangled and twisted with each other when washing.

Moreover, according to the washing machine of the present invention constructed as described above, a washing operation is performed by the water current generated by the rotation of the pulsator and the water current generated by widening and narrowing of the variable pulsator in width can be broken by the current generated by widening and narrowing of the variable pulsator in width. As a result, random currents are made in washing, and the laundry articles are washed while they are impacted by the water currents in random directions. Consequently, efficiency of washing is greatly increased.

BRIEF DESCRIPTION OF THE DRAWINGS

The above objects and other advantages of the present invention will become more apparent by describing in detail preferred embodiments thereof with reference to the attached drawings in which.

DESCRIPTION OF THE PREFERRED EMBODIMENTS

Hereinafter, the present invention will be described in detail with reference to the accompanying drawings.

Figure 1:
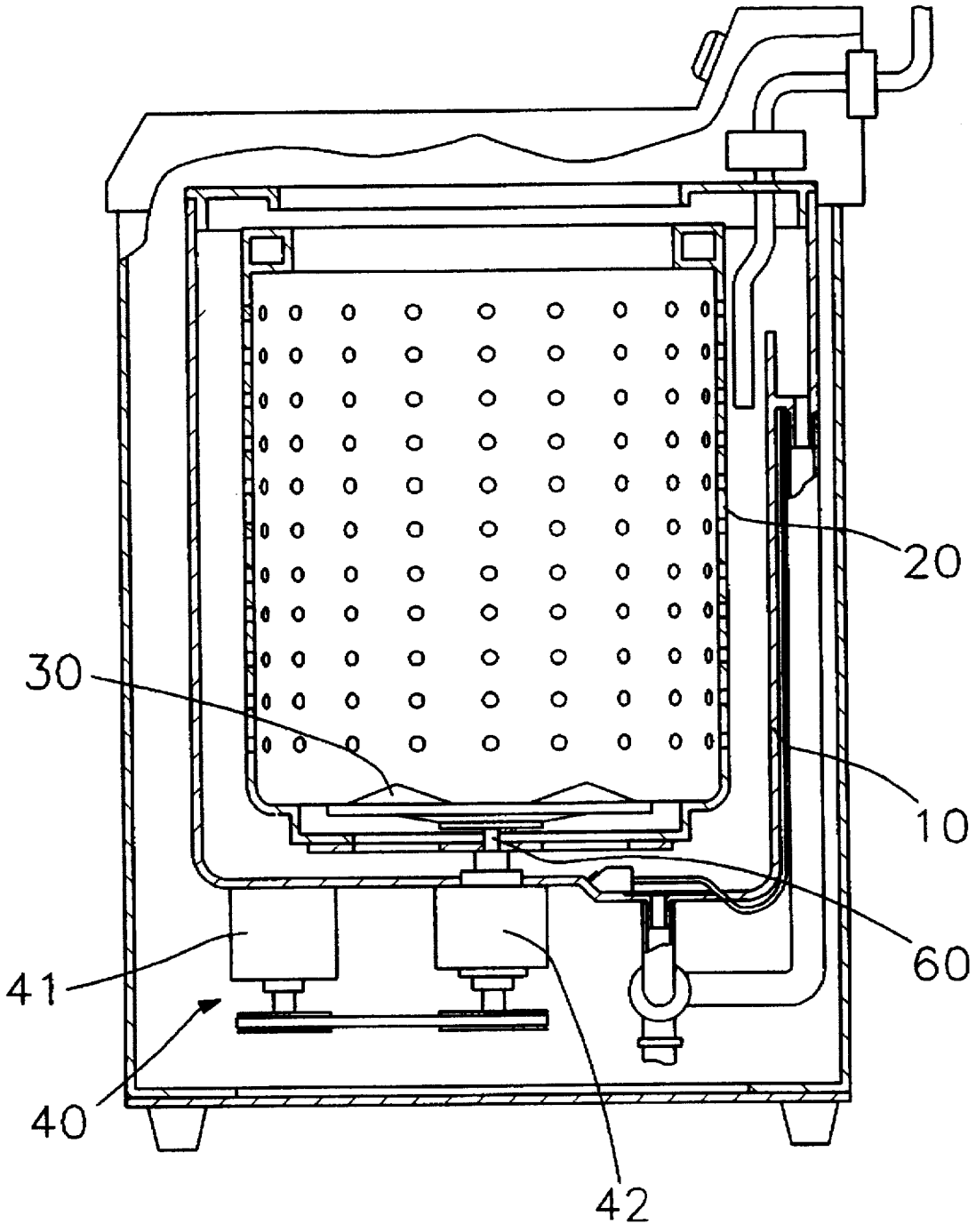
FIG. 1 is a schematic cross-sectional view of a one-tub type washing machine having a pulsator according to the prior art.
Figure 2:
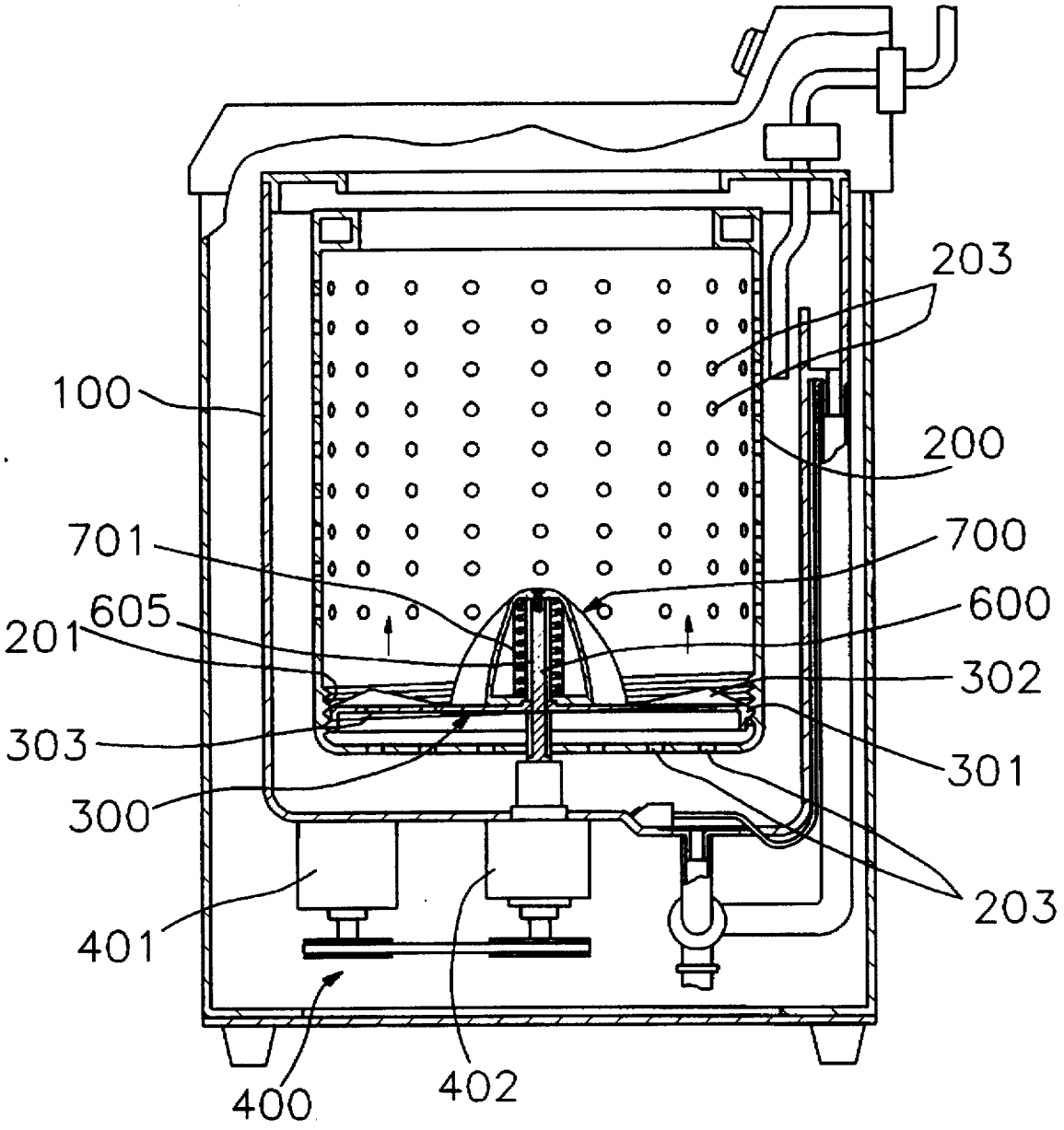
FIG. 2 is a schematic cross-sectional view of a one-tub type washing machine having a variable pulsator according to the present invention.
Figure 3:
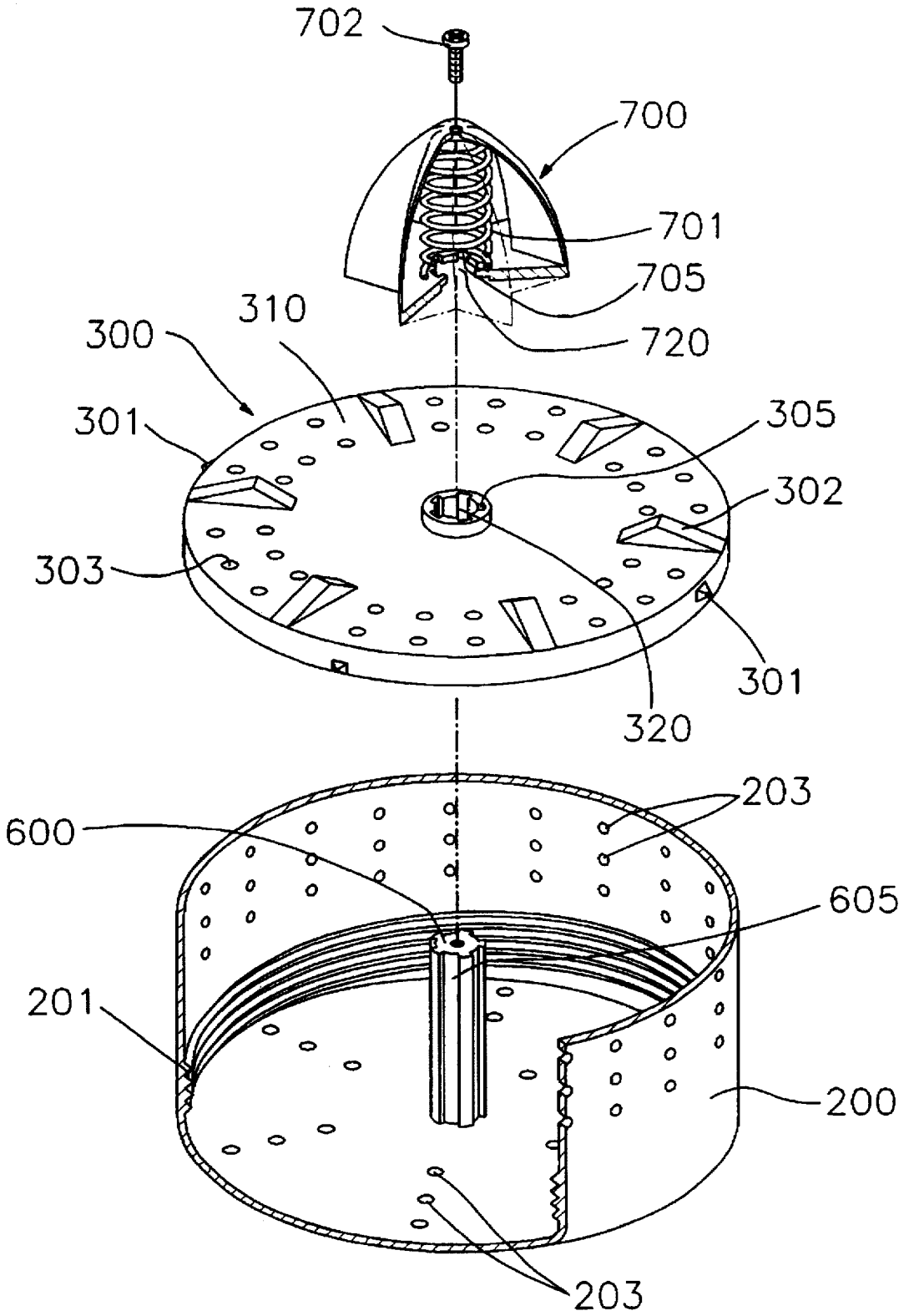
FIG. 3 is an exploded and enlarged perspective view of a variable pulsator, a pulsator, and a washing tub in order to clearly describe their relationship in the one-tub type washing machine of FIG. 2.

FIG. 2 is a schematic cross-sectional view of a one-tub type washing machine having a variable pulsator according to the present invention, and FIG. 3 is an exploded and enlarged perspective view of a variable pulsator, a pulsator, and a washing tub in order to clearly describe their relationship in the one-tub type washing machine of FIG. 2.

As shown in FIGS. 2 and 3, reference numeral 100 denotes a stationary tub for receiving a washing water.

A rotating shaft 600 is upward installed at the center of the bottom thereof and has first axial grooves 605.

A washing tub 200 has a plurality of washing water communication holes 203, being rotatable on rotating shaft 600 coaxially with stationary tub 100. The washing tub has a spiral guide groove 201 formed at its lower inner surface. A driving part 400 having a motor 401 and clutch assembly 402 is installed at a predetermined position at the lower outside part of stationary tub 100 in order to drive a rotating shaft 600 which is a double shaft composed of a washing tub-rotating shaft 610 and a pulsator-rotating shaft 620.

A pulsator 300 is rotatable mounted on rotating shaft 600 on the bottom of washing tub 200. Pulsator 300 has a main body 310 of a round plate shape having an opening 320 formed at its center, and a plurality of ribs 302 radially formed on an upper surface of main body 310. Pulsator 300 also has a plurality of communication holes 303 through which washing fluid flows freely. Pulsator 300 has guide projections 301 formed on an outer side of the round plate shaped main body 310, guide projections 301 being guided along spiral guide groove 201 of washing tub 200. Pulsator 300 has second axial grooves 305 which are spline-engaged with first axial grooves 605 and formed on the inner side of its main body 310. In the rotation of pulsator rotating shaft 620, pulsator 300 is rotated. Simultaneously with its rotating, pulsator 300 is moved upward or downward.

A variable pulsator 700 is disposed on pulsator 300 at an upper position of rotating shaft 620, and more detachably, at an upper position of pulsator-rotating shaft 620. Variable pulsator 700 is preferably a hollow body of which plane cross section has a star shape. Variable pulsator 700 has a bottom with an opening 720 formed at its center, of which inner side is provided with third axial grooves 705. Third axial grooves 705 are spline-engaged with the first axial grooves 605. A top of the variable pulsator 700 is fixed on the top of rotating shaft 600 by a screw 702. Furthermore, variable pulsator 700 has a compressed spring 701 through which the rotating shaft 600 is inserted. Thereby, the bottom of variable pulsator 700 is tightly contacted with a top of pulsator 300 by its elasticity. Thus, the bottom of the variable pulsator 700 is moved up and down depending on the upward and downward movement of the pulsator 300, so that a width of the variable pulsator 700 can become wider and narrower.

A driving part 400 is installed at the position of the lower part of the outside of stationary tub 100 in order to drive rotating shaft 600 which is a double shaft composed of washing tub-rotating shaft 610 and pulsator-rotating shaft 620. Rotating shaft 600 is rotated by driving the driving part 400, by which washing tub 20, pulsator 300 and variable pulsator 700 are rotated on rotating shaft 600. Detailedly speaking, driving part 400 rotates only pulsator-rotating shaft 610 or rotates both pulsator-rotating shaft 610 and washing tub-rotating shaft 620 by the working of the clutch assembly 410 thereof depending on the desired washing mode.

Hereinbelow, the operation of the washing machine with a variable pulsator according to the present invention constructed as above will be described.

In the event of washing operation, driving part 400 is driven in the state that the washing water is received by the desired amount in stationary tub 100. Pulsator-rotating shaft 620 installed at the center of the bottom of stationary tub 100 is rotated by driving the driving part 400.

Since the first axial grooves formed at pulsator-rotating shaft 620 are spline-engaged with second axial grooves 305 formed at opening 320 of the center of pulsator 300 and third axial grooves 705 formed at opening 720 of the center of variable pulsator 700, pulsator 300 and variable pulsator 700 are simultaneously rotated on pulsator-rotating shaft 620.

In these rotations, pulsator is clockwise or counterclockwise rotated. Depending on these rotations, pulsator 300 can be respectively moved downward or upward along revolving shaft 600.

Due to the regular rotations of pulsator 300, the washing water is rotated and centrifugally forced to rise along the wall of washing tub 200 and then falls toward the center of washing tub 200. Thus, pulsator 300 generates a heart-shaped vortex current which rises along the wall of washing tub 200 and then falls toward the center of washing tub 200.

The bottom of variable pulsator 700 is tightly contacted with a top of pulsator 300 by the elasticity of the compressed spring 701 in variable pulsator 700. Simultaneously with this, a top of the variable pulsator 700 is fixed on the top of rotating shaft 600 by a screw 702. Thus, when pulsator 300 is moved upward, the bottom of the variable pulsator 700 is moved up, so that the variable pulsator 700 is expanded in width and decreased in height. On the other hand, when pulsator 300 is moved downward, the bottom of the variable pulsator 700 is moved down, so that the variable pulsator 700 is shrunk in width and increased in height.

Due to the regular expansion and shrinkage operations of variable pulsator 700 in width, the washing water is repeatedly concentrated on and diverged from rotating shaft 600 radially. This current breaks the heart-shaped vortex current generated by pulsator 300. Since the above mentioned currents of various directions in washing tub 200 come into collisions with each other to go toward random and irregular directions, the washing water gives impact on the laundry articles in random directions in washing operation. Thus, efficiency of washing is largely increased.

According to the washing machine of the present invention constructed as described above, in a washing operation, the circular water current in the horizontal plane generated by the revolution of the pulsator can be broken by the water current generated by expansion and shrinkage of the variable pulsator in width. Therefore, it can be prevented that the laundry articles are tangled and twisted with each other when washing.

Moreover, according to the washing machine of the present invention constructed as described above, a washing operation is performed by random and irregular currents which are generated by collisions of the water current generated by the revolution of the pulsator and the water current generated by expansion and shrinkage of the variable pulsator. As a result, in washing, the laundry articles are stricken by washing water in random directions to be washed. Consequently, the laundry articles can be washed with effect which the laundry is rubbed and beaten in various directions, and the laundry can be washed without damage to cloths because the laundry articles are washed without being rubbed directly with the washing rod or the wall of washing tub.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A washing machine with a variable pulsator, comprising:

a stationary tub for receiving washing water during a washing operating;

a rotating shaft disposed on a central part of a bottom surface of the stationary tub, the rotating shaft being a double shaft composed of a pulsator-rotating shaft and a washing tub-rotating shaft;

a washing tub installed in the stationary tub under a rotatable condition with the washing tub-rotating shaft, the washing tub having a plurality of washing water communication holes, and the washing tub having a spiral guide groove formed on its lower inner surface;

a pulsator installed at a lower part of the pulsator-rotating shaft in the washing tub under a rotatable condition with the pulsator-rotating shaft, and a circular edge of the pulsator being guided along the spiral guide groove of the washing tub so that while the pulsator is rotated by the pulsator-rotating shaft, the pulsator is movable up or down along the pulsator-rotating shaft depending on the rotating direction;

a variable pulsator disposed at an upper part of the pulsator on the pulsator-rotating shaft under a rotatable condition with the pulsator-rotating shaft, a top of the variable pulsator being fixed on the rotating shaft, and a bottom part of the variable pulsator being in contact with the pulsator, so that when the pulsator is moved upwardly, the bottom part of the variable pulsator contacted on the pulsator is moved upwardly and thereby a width of the variable pulsator becomes wider and when the pulsator is moved downwardly, the bottom part of the variable pulsator contacted on the pulsator is moved downwardly and thereby the width of the variable pulsator becomes narrower; and a driving part for rotating only the pulsator-rotating shaft or for rotating both the pulsator-rotating shaft and the washing tub-rotating shaft depending on a washing mode in order to operate the washing tub, the pulsator, and the variable pulsator.

2. A washing machine as claimed in claim 1, wherein the pulsator has a main body of a round plate shape having an opening formed at its center and a plurality of communication holes through which washing fluid flows freely, and a plurality of ribs formed on an upper surface of the main body.

3. A washing machine as claimed in claim 2, wherein the pulsator has guide projections formed on an outer-circumferential face of the main body of round plate shape at a corresponding position to the spiral guide groove formed at the lower inner surface of the washing tub.

4. A washing machine as claimed in claim 2, wherein the pulsator-rotating shaft has first axial grooves; the pulsator has second axial grooves which are spline-engaged with the first axial grooves and formed on the inner side of its main body, so that, when the pulsator-rotating shaft is rotated, the pulsator is rotated and the pulsator is movable upward or downward depending on a rotating direction of the pulsator.

5. A washing machine as claimed in claim 4, wherein the variable pulsator is a hollow body of which plane cross section has a star shape, the variable pulsator having a bottom part with an opening formed at its center, an inner-circumferential face of the bottom part is provided with third axial grooves which are to be spline-engaged with the first axial grooves, so that when the pulsator is moved upwardly, the bottom part of the variable pulsator contacted on the pulsator is moved upwardly and thereby a width of the variable pulsator becomes wider and when the pulsator is moved downwardly, the bottom part of the variable pulsator contacted on the pulsator is moved downwardly and thereby the width of the variable pulsator becomes narrower.

6. A washing machine as claimed in claim 5, wherein the variable pulsator has a spring therein through which the pulsator-rotating shaft is inserted, whereby the bottom of the variable pulsator is tightly contacted with a top of the pulsator by its elasticity.

7. A washing machine as claimed in claim 4, wherein the first axial grooves of the rotating shaft are formed on a corresponding portion of an upper part of the bottom surface of the washing tub since the pulsator which is spline-engaged with the first axial grooves is to be moved upward and downward in the washing tub.

8. A washing machine with a variable pulsator, comprising:

a stationary tub for receiving washing water during a washing operation;

a rotating shaft disposed at a center of a bottom of the stationary tub, the rotating shaft being a double shaft composed of a pulsator-rotating shaft and a washing tub-rotating shaft, the rotating shaft having first axial grooves;

a washing tub installed in the stationary tub under a rotatable condition with the washing tub-rotating shaft, the washing tub having a plurality of washing water communication holes, and the washing tub having a spiral guide groove formed on its lower inner surface;

a pulsator installed at a lower part of the pulsator-rotating shaft in the washing tub under a rotatable condition with the pulsator-rotating shaft, the pulsator having a main body of a round plate shape having an opening formed at its center, a plurality of communication holes through which washing fluid flows freely, and a plurality of ribs formed on an upper surface of the main body, the pulsator having guide projections formed on an outer-circumferential face of the main body of round plate shape at a corresponding position to the spiral guide groove formed at a lower inner surface of the washing tub, and the pulsator having second axial grooves which are to be spline-engaged with the first axial grooves and which are formed on an inner-circumferential face of its main body, so that while the pulsator is rotated by the pulsator-rotating shaft, the pulsator is movable up or down along the pulsator-rotating shaft depending on the rotating direction;

a variable pulsator disposed at an upper part of the pulsator on the pulsator-rotating shaft under a rotatable condition with the pulsator-rotating shaft, a width of the variable pulsator becoming wider or narrower depending on an upward or a downward movement of the pulsator in rotation of the pulsator-rotating shaft, the variable pulsator having a hollow body of which plane cross section has a star shape, the variable pulsator having a bottom part with an opening formed at its center, inner-circumferential face of which is provided with third axial grooves which are spline-engaged with the first axial grooves, and the variable pulsator having a spring therein through which the pulsator-rotating shaft is inserted, so that the bottom of the variable pulsator is tightly contacted with a top part of the pulsator by its elasticity, so that, in rotation of the pulsator-rotating shaft, when the pulsator is moved upwardly with rotation of the pulsator, the bottom part of the variable pulsator contacted on the pulsator is moved upwardly and thereby a width of the variable pulsator becomes wider and when the pulsator is moved downwardly, the bottom part of the variable pulsator contacted on the pulsator is moved downwardly and thereby the width of the variable pulsator becomes narrower, and a driving part for rotating only the pulsator-rotating shaft or for rotating both the pulsator-rotating shaft and the washing tub-rotating shaft depending on a washing mode in order to operate the washing tub, the pulsator, and the variable pulsator.

* * * * *